United States Patent [19]

Leclerc et al.

[11] 4,268,305

[45] May 19, 1981

[54] PROCESS FOR TREATING LIQUID STEEL INTENDED IN PARTICULAR FOR MANUFACTURING MACHINE WIRE

[75] Inventors: Jacques Leclerc, Valenciennes; Rene Cormet, Herserange; Guy Marcus, Mont-Saint-Martin, all of France

[73] Assignee: Union Siderurgique du Nord et de l'est de la France, Paris, France

[21] Appl. No.: 891,453

[22] Filed: Mar. 29, 1978

[30] Foreign Application Priority Data

Mar. 31, 1977 [FR] France ..... 77 09737

[51] Int. Cl.[2] ..... C21C 7/00

[52] U.S. Cl. ..... 75/48; 75/53; 75/58; 75/129; 75/130 R

[58] Field of Search ..... 75/48, 53, 58, 129, 75/130 R

[56] References Cited

U.S. PATENT DOCUMENTS

| | | | |
|---|---|---|---|
| 2,275,088 | 3/1942 | Nielsen | 75/48 |
| 3,467,167 | 9/1969 | Mahin | 75/57 |
| 3,702,243 | 11/1972 | Miltenberger | 75/57 |

*Primary Examiner*—P. D. Rosenberg

*Attorney, Agent, or Firm*—Burns, Doane, Swecker & Mathis

[57] ABSTRACT

The present invention relates to a process for treating liquid steel for the manufacture of machine wire. All or part of the manganese is added to an extra-mild steel, obtained after refining by any steelmaking process, directly in the production apparatus to obtain the desired manganese content. The steel thus obtained is poured into a first ladle or into another pouring apparatus and carbon is added to the liquid mass in the first ladle and thereafter the metal obtained is poured into a second ladle and a given amount of, first, silicon and then aluminium is added. This process produces a machine wire which is more suitable for wiredrawing.

6 Claims, 1 Drawing Figure

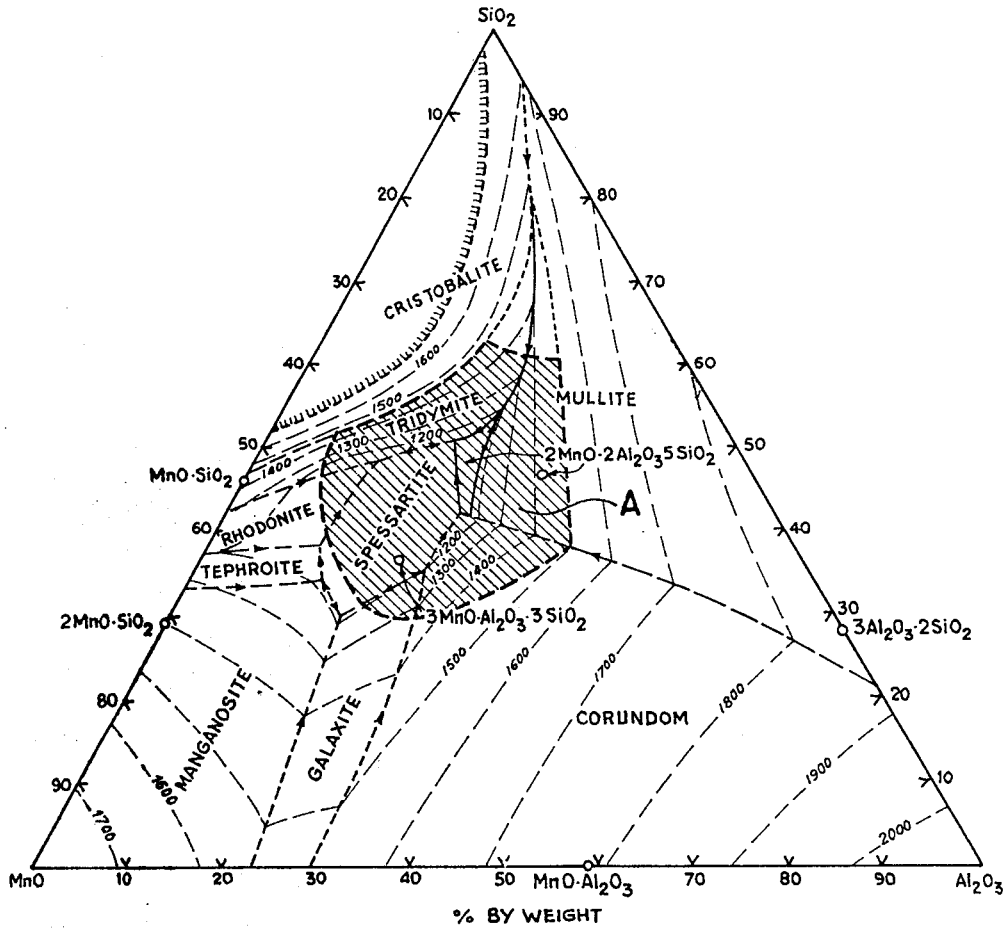
SiO2
CRISTOBALITE
TRIDYMITE
MULLITE
2MnO·2Al2O3·5SiO2
A
MnO·SiO2
RHODONITE
TEPHROITE
SPESSARTITE
2MnO·SiO2
3MnO·Al2O3·3SiO2
3Al2O3·2SiO2
MANGANOSITE
GALAXITE
CORUNDOM
MnO
MnO·Al2O3
Al2O3
% BY WEIGHT

PROCESS FOR TREATING LIQUID STEEL INTENDED IN PARTICULAR FOR MANUFACTURING MACHINE WIRE

The present invention relates to a process for treating liquid steel intended in particular for the manufacture of machine wire or rod which may be used in particular in the preparation of cables for tire carcasses or other like reinforcing elements.

The metal reinforcing elements for tires are produced from twisted cables comprising a plurality of fine wires obtained by a cold wiredrawing operation down to a very small diameter (to about 0.15 mm) of a hot-rolled machine wire or rod. Bearing in mind the envisaged utilization, this machine wire must be produced in a grade of steel which must have the following characteristics:

homogeneous and precise chemical composition;
minimum content of non-metallic inclusions;
composition and structure of the non-metallic inclusions which impart thereto good deformability properties in the cold state.

Heretofore, the steel employed for manufacturing a machine wire or rod was a steel produced by a conventional process in respect of which the sole important precautions concerned the property of the steel and the minimum incorporation of killing elements.

Now, the steel prepared in this way nonetheless comprises a large proportion of non-metallic inclusions formed by the combination of the killing elements with the oxygen of the metal which results in a poor wiredrawing capability of the machine wire obtained.

Indeed, the inclusions constituted by these refractory minerals are hard and therefore but little deformable and result in rapid wear of the wiredrawing dies and fracture of the wire in the course of the final twisting operation owing to the heterogeneous distribution of these inclusions.

Thus, in order to minimize the killing elements to be added, currently-employed conventional processes are carried out in particular by degassing the steel as far as possible by the use of an installation for placing the pouring ladle containing the treated liquid steel under a vacuum. However, such an installation is expensive in construction and operation and does not produce alone the desired results for obtaining machine wires.

Although it does not disclose a process for obtaining a machine wire, French Pat. No. 1,235,699 teaches employing an agitation by means of an inert gas to achieve an improved deoxidation, but this process is also unsatisfactory in the application envisaged in the present invention.

An object of the present invention is to overcome these drawbacks by providing a process for producing a steel for a machine wire which has a homogeneous composition, much smaller amounts of inclusions and good cold deformability properties.

According to the invention, there is provided a process for treating liquid steel for manufacturing machine wire, comprising adding all or part of the manganese to an extra-mild steel, obtained after refining by any steel production process, directly in the steel production apparatus to obtain the desired manganese content, pouring the steel thus obtained into a first ladle or into another pouring apparatus and adding carbon to the liquid mass in the first ladle and pouring the steel obtained into a second ladle and adding a given amount of, first, silicon and then aluminium.

According to another feature of the invention, an element selected from calcium, barium and strontium may also be added at the same time as the silicon.

The three-stage process according to the invention therefore permits obtaining an appropriate grade of the steel to produce the required qualities of the machine wire.

The addition of manganese to the steel in the production apparatus, which may be a furnace or converter, is achieved for example by means of ferro-manganese added in the proportion of 0.5–1.5% by weight of Mn, calculated in the elementary form, so as to obtain a Mn content in the steel higher than 0.3% and in particular 0.4–0.8%. This addition of Mn results in a beginning of a deoxidation and the MnO which is partly incorporated in the slag is eliminated at the same time as the latter.

The metal treated with the manganese is then poured into a first pre-heated ladle or into another pouring apparatus (which, may be, for example, a furnace).

Carbon, in a particularly appropriate form powdered graphite, is then added in this first ladle in a sufficient amount to continue the deoxidation of the steel and give the desired carbon content of the steel. The carbon is added in the proportion of 0.1–1.0% by weight. Thus a part of the carbon added combines with the oxygen to form carbon monoxide which is eliminated in the gaseous form. The carbon is introduced in the liquid mass by any means ensuring a homogeneous distribution of this element, for example in the form of a powder immersed in an inert gas such as argon directly introduced into the steel.

The amount of carbon added is such that a carbon content is obtained in the steel which is higher than 0.2% by weight and preferably 0.6–0.8% by weight.

Subsequent to this second stage, the liquid steel has already undergone two successive deoxidations, namely a first deoxidation by means of the manganese which was partly eliminated in the form of MnO, and a second deoxidation by means of the carbon a part of which was eliminated in the gaseous form. Consequently, a considerable deoxidation of the steel is achieved with a minimum amount of killing elements. This reduction in the amount of the killing elements facilitates the obtainment of the desired properties since it reduces to a minimum the amount of inclusions which are necessarily present.

The steel obtained at the end of the second stage is then transferred to a second pouring ladle which is preferably preheated. In this second ladle, the steel is subjected to a final deoxidation by the addition of given amounts of, first, silicon and then aluminium so as to obtain oxidized inclusions which correspond to the desired composition of these inclusions which have advantageous deformability properties.

The silicon is added first of all in the form of ferrosilicon or silicon alloy in the proportion of about 1–4 kg. per metric ton of steel corresponding to an added amount, calculated in the form of elementary silicon, of 0.006–0.26% by weight, so as to obtain a silicon content in the steel of lower than 0.3%. The aluminium is then added in the proportion of 0.0005–0.010%, calculated in the elementary form, so as to obtain a final aluminium content in the steel of less than 0.010% by weight which generally corresponds to an addition of 10 to 20 grams of aluminium per metric ton of steel.

The amounts of silicon and aluminium added must be determined at the moment of use in the particular steel employed by taking into account the manganese content already present, so as to bring the composition of the oxidized inclusions within the range of maximum plasticity of the given ternary diagram represented by the crosshatched zone A of the accompanying FIGURE.

The process according to the invention permits achieving for the composition of the oxidized inclusions the maximum plasticity range which is particularly appropriate for obtaining the required deformability properties of the inclusions. Now, this range can only be obtained by means of prior deoxidations which leave only a minimum amount of non-metallic inclusions, since they have been partly produced with the use of carbon and manganese.

According to another manner of carrying out the invention, a killing element selected from calcium, barium and strontium may also be employed as a final killing element in addition to the silicon and aluminium in the course of the treatment in the second ladle.

This element is then introduced at the same time as the silicon in the proportion of 0.001–0.04% by weight, calculated in the elementary form, relative to the steel. The aluminium is then introduced after the addition of the silicon and the additional killing element.

In the case of the use of this additional killing element, the proportions of Si and Al added remain identical to those hereinbefore defined.

A preferred additional killing element is calcium which is introduced into the steel at the same time as the silicon in the form of silico-calcium.

It is essential in the process of the invention to take care that the steel in the second pouring ladle is maintained at a temperature distinctly higher than the beginning of the freezing (liquidus) of the considered steel composition, for example 50°–70° C.

This result may be obtained by employing, for each of the two treating operations outside the production apparatus, ladles preheated to a temperature of at least 1200° C. and provided with sliding nozzles.

EXAMPLE

One manner of carrying out the process of the invention is summarized in the following Table I.

A steel produced in the converter is blasted until it reaches an extra-mild state and has the indicated initial characteristics.

TABLE I

| Steps of the treatment | Temperature ° C. | Activity $O_2$ in ppm | Content of C % × $10^{-3}$ | Mn % × $10^{-3}$ | P % × $10^{-3}$ | S % × $10^{-3}$ | Si % × $10^{-3}$ | Al % × $10^{-3}$ |
|---|---|---|---|---|---|---|---|---|
| End of the blasting in the converter | — | 1110 | 14 | 90 | 26 | 15 | — | — |
| First stage in the converter After addition of 12,3 kg/t of ordinary FeMn carbide + lime + soda | 1610 | 350 | 85 | 636 | 24 | 12 | — | — |
| 2nd stage - Pouring into an intermediate ladle N°1 + recarburization by injection of 7,7 kg/t of graphite | 1540 | 40 | 730 | 613 | 26 | 14 | — | — |
| 3rd stage - Transfer to the ladle N°2 + final deoxidation by addition of 3,0 kg/t of FeSi + 20 g/t of Al. | 1515 | 15 | 725 | 600 | 26 | 14 | 192 | 2 |

The process according to the invention therefore permits grading a steel intended for manufacturing a machine wire having improved wiredrawing properties. Indeed, these properties are obtained owing to the presence of cold-deformable oxidized inclusions which are present in a minimum amount. These results are obtained by a deoxidation of the steel which, achieved partly by elements, namely the manganese and the carbon, the products of combination of which with the oxygen are substantially completely eliminated before the final stage, is completed and terminated with elements such as silicon, aluminium, and possibly calcium, barium and strontium the addition of which may be adjusted to a minimum amount which corresponds to a maximum plasticity range of the inclusions. Thus, in the case of the use of Mn, Si and Al, this maximum plasticity range corresponds to the zone A of the ternary diagram $Al_2O_3$ - $SiO_2$ - MnO in the accompanying FIGURE.

The killing conventionally carried out on steel by the addition of deoxidizing elements in one go did not permit obtaining this required particular composition and consequently the cold-deformability properties of the inclusions.

Although this feature is secondary, the steel may also be treated in caisson-ladles which enable the process to be carried out under a vacuum, such as for example those disclosed in the French patent application 70 00 579, possibly provided with stirring means, such as a bubbling of argon through a porous brick.

Having now described our invention what we claim as new and desire to secure by Letters Patent is:

1. A process for the preparation of a steel which contains a minimum amount of oxidized inclusions and which exhibits improved wiredrawing properties comprising the steps of:

refining steel to produce an extra-mild steel;

adding sufficient manganese to a liquid mass of said refined steel to provide a steel containing greater than 0.3 percent by weight of manganese;

thereafter adding sufficient carbon to said liquid mass of steel to provide a steel containing greater than 0.2 percent by weight of carbon, said manganese and carbon being added in amounts sufficient to substantially deoxidize the steel; and thereafter adding silicon and then aluminum to said liquid mass of steel in amounts sufficient to provide a composition of oxidized inclusions in the steel within the range of maximum plasticity defined by zone A of the FIGURE.

2. The process of claim 1 wherein about 0.5 to 1.5 percent by weight of manganese, calculated as the elemental metal, is added to the steel.

3. The process of claim 1 wherein about 0.1 to 1.0 percent by weight of carbon is added to the steel.

4. The process of claim 1 wherein about 0.06 to 0.26 percent by weight of silicon and about 0.0005 to 0.01 percent by weight of aluminum, calculated as elemental metals, are added to the steel.

5. The process of claim 1 wherein about 0.001 to 0.04 percent of an additional element selected from the group consisting of calcium, barium and strontium is added to the steel together with the silicon, calculated in the elemental form.

6. The process of claim 1 wherein the liquid mass of steel to which the silicon and aluminum are added is at a temperature which is at least 50° C. greater than the liquidus temperature of the steel.

* * * * *